United States Patent [19]

Frei

[11] Patent Number: 4,674,435

[45] Date of Patent: Jun. 23, 1987

[54] DEVICE FOR APPLYING A PROTECTIVE COATING TO THE WELD OR SOLDER SEAM OF A CAN BODY

[75] Inventor: Matthias Frei, Wettingen, Switzerland

[73] Assignee: Elpatronic AG, Switzerland

[21] Appl. No.: 729,296

[22] Filed: May 1, 1985

[30] Foreign Application Priority Data

May 7, 1984 [CH] Switzerland ..... 2237/84

[51] Int. Cl.[4] ..... B05C 1/02

[52] U.S. Cl. ..... 118/69; 118/212; 118/215; 118/254; 118/DIG. 15; 29/121.7

[58] Field of Search ..... 118/215, 212, DIG. 14, 118/DIG. 15, 254, 69, DIG. 10; 29/121.6, 121.7

[56] References Cited

U.S. PATENT DOCUMENTS 1,445,107 2/1923 Scott et al. ..... 29/121.6 X 4,361,113 11/1982 Atsuyuki ..... 118/215 X

*Primary Examiner*—John P. McIntosh

[57] ABSTRACT

A device for applying a protective coating to the weld or solder seam of a can body has an application roller (2) serving to apply a coating material inside a region covering the seam at the inside (15) of the can body. The roller periphery has a cross-sectional profile (5) comprising at least one depression (10) in a middle region (9) of a middle portion (6) having a region width of less than 60% of the width of the middle portion (6). The profile (5) further comprises at least one salient point and/or at least two points of inflection in this middle region (9). The device renders it possible to achieve optimum layer thicknesses of the coating over the seam, which are neither too little for the stresses occurring during the long-term storage of corrosive liquids nor too great for the tearing strength stressing of the coating which occurs during the flanging over of the edges of the can body. As a result of the form of the roller, an optimum profile of the coating layer applied results, with the greatest layer thickness immediately above the seam.

21 Claims, 11 Drawing Figures

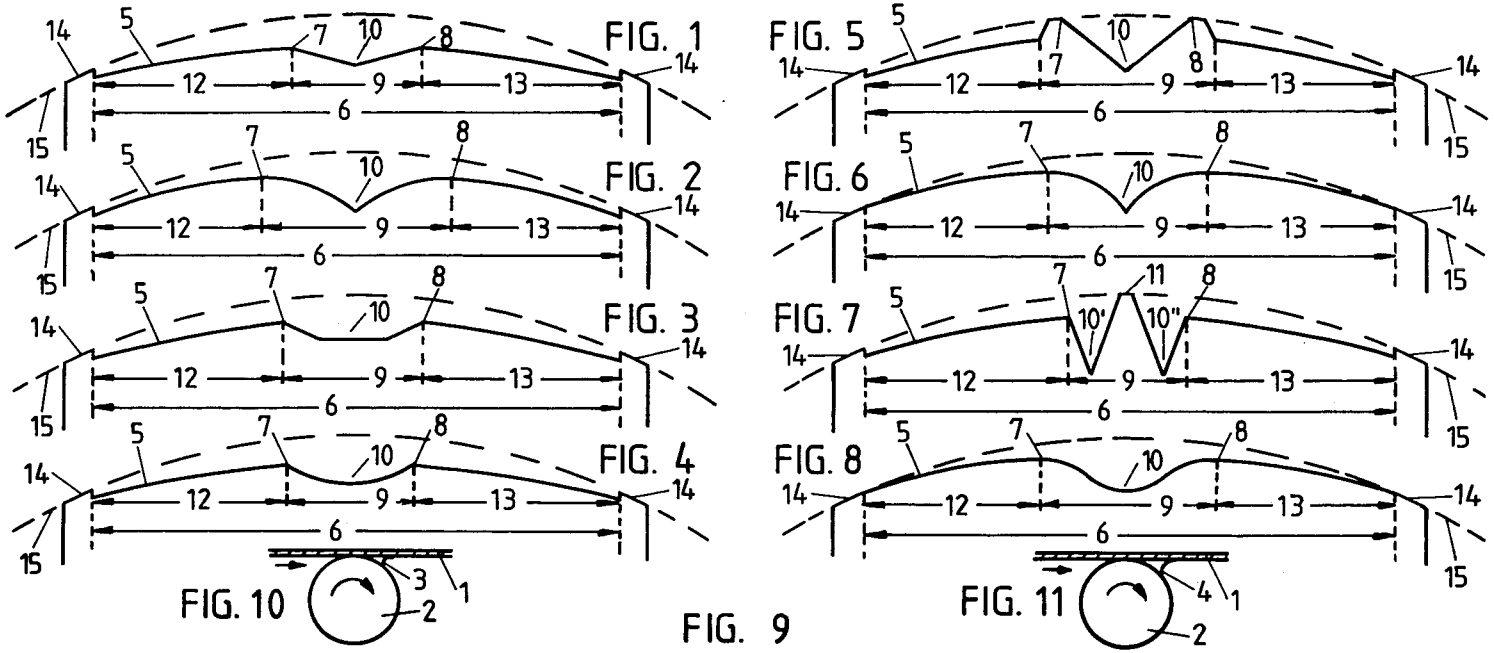
FIG. 1
FIG. 2
FIG. 3
FIG. 4
FIG. 5
FIG. 6
FIG. 7
FIG. 8
FIG. 9
FIG. 10
FIG. 11
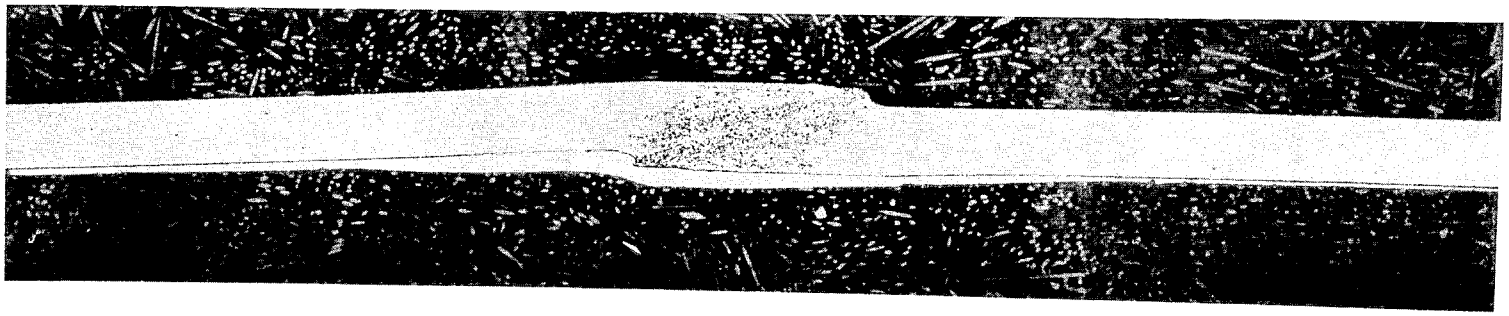

DEVICE FOR APPLYING A PROTECTIVE COATING TO THE WELD OR SOLDER SEAM OF A CAN BODY

The invention relates to a device for applying a protective coating to the weld or solder seam of can bodies, having an application roller which serves to apply a coating material (e.g. a lacquer) within a region covering the seam at the inside of the can body and which comprises two lateral supporting edges serving to support the can body on the application roller, and a middle portion situated between the supporting edges and serving to convey and apply the coating material.

Such devices of this type are known, for example, from the CH-PS No. 624591, the DE-PS No. 3134968 and the U.S. Pat. No. 4,361,113, in which the roller middle position extends from the centre of the roller towards each of the two sides of the roller as far as the last salient point or point of inflection (Knick- bzw. Wendepunkt) of a peripheral surface cross-section or generating line (Mantellinie) or cross-section representing the transverse profile of the roller and extending from one side of the roller to the other, before the point or the beginning of the region on the profile or, in the absence of such a salient point or point of inflection, reaches to the point or beginning of the region in which the can body comes to bear against the supporting edge associated with the side of the roller in question.

These, and also all other known devices of the same type are, however, unsuitable, through a number of different reasons, for providing the weld seams of can bodies with a lacquer coating which is optimum from every point of view. And newer devices of this type, which have been produced in order to overcome disadvantages in devices previously used, apart from eliminating the disadvantages in question, as intended, have often led to new disadvantages which again made it impossible to achieve the object of lacquer coatings which were optimum from every point of view. For these reasons, it has already become more accepted that, under the conditions prevailing in modern can welding machines, such as travelling speeds of the can bodies of the order of magnitude of 1 m/sec and resulting speeds of rotation of the application roller of about 500 revolutions per minute, as well as cooling times of only about 1 second resulting at these travelling speeds with distances which are still practicable, of not more than 1 m, for example, between welding station and lacquering station, and correspondingly high temperatures of the weld seam when the lacquer is applied, it is no longer possible, in practice, to apply a lacquer coating to the weld seams at the insides of can bodies, which would, even under the most unfavourable circumstances, be equal to all the requirements arising during the further processing of the can bodies and the later use of the cans. These requirements include crack resistance during the flanging over of the edges of the can bodies, the complete freedom from pores and permanent resistance even to highly aggressive and strongly corrosive contents, the exclusion of any gas occlusions not only inside the lacquer but also between the lacquer coating and the region on the inside of the can body covered thereby as well as the complete wetting of this region and in particular also of the recesses of the weld seam therefore necessary at the moment of applying the lacquer, and finally the necessary firm adhesion of the lacquer to the support, particularly in the marginal regions of the coating. For these reasons, in practice, there is an increasing changeover, in modern can welding machines, to covering the inside of the weld seam, not with a coat of lacquer but with a coat of plastics particles which are applied in powder form and then melted and fused by the action of heat, although this is considerablv more expensive than the application of a coat of lacquer.

The difficulties which have arisen in connection with the various known devices of the type mentioned at the beginning can partly be seen directly from the above-mentioned sources and are partly clear to the expert from the information given in individual literary sources with regard to the devices mainly described there. Originally, when the rotation of the application roller was still caused by entrainment of the roller lying on the surface to be lacquered during the relative movement between roller and surface in the manner usual with painters' rollers, a main difficulty was an uneven application of lacquer in the longitudinal direction of the can bodies and, in particular, too small an application of lacquer at the beginning of each individual can body, as a result of the stopping of the roller during the intervals when a preceding can body had already passed the roller and a following can body had not yet reached the roller (see CH-PS No. 624591, page 2, right-hand column, lines 15–26). This and other difficulties arising with an application roller entrained by the can body, such as the necessity for a high contact pressure of the roller on the can body and lacquering faults caused as a result (CH-PS Nos. 624591, page 2, right-hand column, lines 17–20), the incomplete lacquering of the first can body after each stoppage of the welding machine and the sorting out of such incompletely lacquered can bodies necessary as a result (CH-PS No. 624591, page 2, right-hand column, lines 23–26) and the risk of the lacquer drying when the application roller was at a standstill as well as the resulting uselessness of the quick-drying lacquers, very desirable in themselves (CH-PS No. 624591, page 2, right-hand column, lines 20–23, 32/33), could be overcome by a continuous drive of the application roller effected independently of the entrainment of the roller by the can body (CH-PS No. 624591, page 2, right-hand column, lines 34–36).

The expectation of being able to achieve optimum lacquer coatings on the weld seams of the can bodies by means of the continuous drive of the application roller (CH-PS No. 624591, page 2, right-hand column, lines 27–32) was not, however, fulfilled under the considerably hard conditions prevailing in practical operation than in the laboratory. On the contrary, the continuous drive of the application roller, even in laboratory operation, required additional means in the form of a specially constructed stripping device partially spanning the generated and lateral surfaces of the application roller (CH-PS No. 624591, claim 4 and page 3, left-hand column, line 54 to right-hand column, line 30) in order to prevent the slinging of excess lacquer away from the roller and a spraying out of lacquer, caused as a result, because of the continuous rotation of the roller, through the spaces between can bodies following one another, and also to be able to influence the thickness of the application of lacquer to the weld seam (CH-PS No. 624591, page 3, left-hand column, lines 61–63 and right-hand column, lines 19–29).

The hoped-for ability to influence the thickness of the lacquer coating, and also the expected ability to select the profile of the layer applied to the weld seam, by appropriate selection of the shape of the stripper (CH-PS No. 624591, page 3, right-hand column, lines 19–29) could only be realized in practice, however, in conjunction with such characteristics as inadequate adhesion of the lacquer to the support in the marginal regions of the layer as a result of incomplete wetting during the application of the laquer (U.S. Pat. No. 4,361,113, column 2, lines 29–32), which made doubtful reliable fulfilment of the main purpose of the lacquer covering of the weld seam, that is to say prevention of any direct contact between corrosive contents and the metal at the weld seam, and therefore were not acceptable. Thus, in fact, there was no ability to select the profile of the layer of lacquer applied to the welding seam by the means described in CH-PS No. 624591. Instead, the complete wetting of the surfaces to be lacquered, at the moment of application was essential because of the need for firm adhesion of the lacquer to the support, required the use of a relatively thin lacquer which in turn only permitted the application of a relatively thin layer with a thickness of the order of magnitude of 2 to 5 microns because of the surface tension, which layer thickness could not be altered by altering the shape of the stripper and which, in particular, did not meet the requirements necessary for long-term storage of corrosive contents, with regard to freedom from pores and resistance to such contents, to an adequate extent (U.S. Pat. No. 4,361,113, column 2, lines 25–29 and 32–35).

An application roller, the peripheral surface of which had a cross-sectional profile with a concave curvature in the middle portion and a convex curvature adapted substantially to the curvature of the can body in the marginal regions forming lateral supporting edges for the support of the can body against the roller, was used in the device described in CH-PS No. 624591 (claim 7 and page 3, right-hand column, lines 31–35). The middle portion of the roller extended, in this case, from the centre of the roller towards each of its two sides with constant concave curvature as far as a salient point in the surface cross-section representing the profile of the roller, adjacent to which was the middle portion at the convex marginal region associated with the side of the roller in question and forming the supporting edge (CH-PS No. 624591, FIGS. 5, 6, 8). This construction of the application roller was partially due to the special construction of the stripping device and the variable shape of the stripper, already mentioned above, for the purpose of being able to select the profile of the layer of lacquer applied to the weld seam (CH-PS No. 624591, page 3, right-hand column, lines 19–29 and FIG. 8), because it had been assumed at the time that the profile of the layer of lacquer applied to the weld seam would also correspond approximately to the free space between application roller and stripper (CH-PS No. 624591, page 3, right-hand column, lines 24–27). This has proved incorrect in practice, however, if ony because of the necessary use of thin lacquer.

The inability to influence the profile of the layer of lacquer applied to the weld seam by the means described in CH-PS No. 624591, because of the necessary use of thin lacuqer, and in particular, also the inadequate thickness of the layer over the weld seam for the long-term storage of corrosive contents, which had become apparent in practice, then led to the proposal which can be seem from DE-PS No. 3134968, to overcome the difficulties which had arisen when applying the layer of varnish with the means described in CH-PS No. 624591 or the corresponding DE-OS No. 2728741, "in adapting the distribution of the coating material transversely to the seam to the particular requirements and circumstances in the optimum manner" (DE-PS No. 3134968, column 1, lines 58–60), by means of two applications disposed one behind the other with such a construction "that the application surface of the one application roller covers the weld or solder seam and two application surfaces of the other application roller, which are separated from one another by an annular groove, act on the regions at each side of the weld or solder seam" (DE-PS No. 3134968, claim 1).

This proposal was based on the argument that, using a more viscous lacquer, it would be possible to apply a layer with a relatively great thickness by the means described in CH-PS No. 624591, which layer would only have been unacceptable because of the inadequate adhesion of the lacquer to the support in the marginal regions of the layer as a result of the incomplete wetting of the support during the application of the lacquer, and that therefore it must be possible to achieve a complete wetting in these marginal regions and hence a firm adhesion of the lacquer to the support by two additional application surfaces subsequently acting again on these marginal regions.

In order to achieve the complete wetting aimed at, however, a pressing of the lacquer against the support, so to speak, or a construction of the two additional application surfaces with a rectilinear or slightly convexly curved peripheral surface cross-section leading to this effect was necessary. With this construction of the two additional application surfaces, the unwanted side effect then resulted that the additional surfaces pressing the lacquer also forced out the applied lacquer in a bead-like manner to both sides at the same time and so a bead of lacquer was formed at each of the two edges of the total layer applied and in turn led to the risk of separation of the layer of lacquer from the support, particularly during the long-term storage of corrosive contents, because gaps form at the underside of the beads and may be the starting point for a gradual lifting of the layer away from the support. In addition, such beads of lacquer are also undesirable because they may tear during the flanging over of the edges of the can bodies and such cracks may likewise be starting points for a gradual separation of the layer of lacquer from the support during long-term storage.

Avoiding the beads of lacquer during the application of the layer to the weld seam with the device described in DE-PS No. 3134968 was in turn only possible by using a relatively thin lacquer with which the main portion of the lacquer was applied by the first application roller provided with relatively high supporting edges and a middle portion with a rectilinear peripheral surface cross-section parallel to the roller axis, and the two additional application surfaces, not provided with supporting edges, conveyed only relatively little lacquer and therefore scarcely forced any lacquer out to the sides when pressing it against the support. Nevertheless a somewhat less thin lacquer could be used with the device according to DE-PS No. 3134968 and so a somewhat greater thickness of the layer over the weld seam of about 5 to 8 microns could be achieved, although this was still not sufficient for the long-term storage of corrosive contents.

In another development, described in U.S. Pat. No. 4,361,113, the object of which was likewise to achieve greater thicknesses of the layer of lacquer over the weld seam, an attempt was made to approach this target by purely experimental means by trying out the most varied application rollers or more precisely by trying out a number of rollers with peripheral surfaces of different shapes (U.S. Pat. No. 4,361,113, column 4, lines 11–26). In this development, the starting point was again the application roller already described above in connection with CH-PS No. 624591 and shown there in FIGS. 5, 6 and 8, the peripheral surface of which roller comprises a concave curvature in the middle portion and a convex curvature at the two lateral supporting edges and wherein the middle portion of the roller extends from the centre of the roller towards each of the two sides of the roller with a constant concave curvature up to a bending point of the peripheral surface line at which the middle portion adjoins the supporting edge having a convex curvature (U.S. Pat. No. 4,361,113, column 4, lines 11–13 and FIG. 2).

Starting from this point, in the experimental development described in the U.S. Pat. No. 4,361,113, an investigation was first made as to whether greater thicknesses of the layer of lacquer over the weld seam could be achieved by further deepening of the middle portion of this application roller profile or by greater concave curvature in this middle portion (U.S. Pat. No. 4,361,113, column 4, lines 13–19 and FIG. 3A). After a fruitless result from this experiment, an attempt was then made to follow the opposite course, that is to say to raise the middle portion in comparison with the profile forming the starting point of the experimentation, first by reducing the concave curvature in this middle portion to zero—that is to say to a rectilinear peripheral surface cross-section or profile in this middle portion—and at the same time reducing the width of the supporting edges to the narrow region of an outer edge U.S. Pat. No. 4,361,113, column 4, lines 21–22 and FIG. 3B), and then by using, instead of an application roller with a concavely curved middle portion, one with a convexly curved middle portion and likewise a width of the supporting edges reduced to an outer edge (U.S. Pat. No. 4,361,113, column 4, lines 22–23 and FIG. 3C), but even this opposite course did not lead to the desired result of an acceptable layer of lacquer with a relative great layer thickness over the weld seam.

Whereas the deepening or raising the middle portion over its whole width as aforesaid had no prospect of success from the beginning, however, the next course followed in this experimental development, of making the peripheral surface cross-section or profile of the application roller wavy (U.S. Pat. No. 4,361,113, column 4, lines 23–24 and FIG. 3D) might have succeeded with suitable further development, for with this shape of the peripheral profile two raised supporting edges having the shape of a sine half-wave and a middle portion with three depressions likewise having the shape of a sine half-wave were already present. But the uniform wave shape of this peripheral surface cross-section, wherein the middle region of the middle portion, formed by the two sindhalf-wave half-wave-shaped raised portions and the middle sine shaped depression, already occupied 60% of the width of the middle portion of the roller between the two sine half-wave-shaped supporting edges, and furthermore the two supporting edges each extended over more than 14% of the total width of the roller, while in addition the middle portion comprised two further sine half-wave-shaped depressions outside its middle region. Again, success was ruled out, in the sense of achieving an acceptable layer of lacquer with a relatively great layer thickness over the weld seam (U.S. Pat. No. 4,361,113, column 4, lines 23–26).

Since the reasons for success and failure naturally could not be recognized simply by trying out application rollers with peripheral surfaces of different profiles (U.S. Pat. No. 4,361,113, column 4, lines 3–7), the failure with the application roller with a wavy peripheral surface could not encourage further development on the lines of a peripheral surface cross-section comprising depressions and raised portions in the middle portion of the roller but, on the contrary, diverted from such further development. And in fact the shape of the application roller found either via various intermediate stages not given in the U.S. Pat. No. 4,361,113 or purely by chance within the scope of the. further experimental development, with which layers of lacquer with thicknesses of the order of magnitude of 200 microns can be applied to the weld seam (U.S. Pat. No. 4,361,113, column 4, lines 27–53 and FIGS. 4A and B), has precisely opposite features in comparison with the application roller shown in FIG. 3D of the U.S. Pat. No. 4,361,113, namely a raised portion in the middle of the middle portion, where there is a depression in FIG. 3D, a rectilinear peripheral surface cross-section parallel to the axis in the regions of the middle portion where the surface cross-section in FIG. 3D has a sinusoidal course, and narrow pointed supporting edges where there are broad sine half-wave-shaped supporting edges in FIG. 3D.

It is true that it was now possible to apply layers of lacquers with very great layer thicknesses of about 180 to 200 microns (U.S. Pat. No. 4,361,113, column 4, line 51 and line 27) to the weld seam using this new shape of the peripheral surface shown in FIGS. 4A and 4B of the U.S. Pat. No. 4,361,113, with an acute-angled raised portion in the middle and one at each of the two lateral ends of the periphery of the roller (U.S. Pat. No. 4,361,113, column 6, lines 6–9), but the object aimed at of applying a lacquer coating, which was optimum from every point of view, to the weld seams of can bodies was still not achieved by this. For the facts not mentioned in U.S. Pat. No. 4,361,113, that firstly layer thicknesses of the lacquer of about 30 to 60 microns already guarantee a permanent resistance even to highly aggressive and strongly corrosive contents and therefore layer thicknesses of 180 to 200 microns are not necessary in order to achieve permanent resistance and secondly the wall thicknesses of the can bodies themselves under consideration only amount to between 160 and 220 microns and with such thin walls, the crack resistance of a lacquer coating of substantially equal thickness can no longer be guaranteed with certainty during the flanging over of the edges of the bodies, make it clear that success in producing layer thicknesses of the coating over the weld seam in the optimum order of magnitude of about 30 to 60 microns was obviously not achieved with the roller shown in FIGS. 4A and 4B of the U.S. Pat. No. 4,36113 but that obviously only relatively thick coatings with a layer thickness of more than 150 microns can be applied with this roller.

It is an object of the present invention to provide a device of the type mentioned at the beginning which is suitable for providing weld seams of can bodies with a lacquer coating which is optimum from every point of view, and which is equal to all the requirements occurring during the further processing of the can bodies and the later use of the cans, such as crack resistance during the flanging over, resistance to corrosive contents, exclusion of gas occlusions in the lacquer and between lacquer and support and firm adhesion of the lacquer to the support.

According to the invention, the device is provided with an application roller comprising lateral supporting edges serving to support the can body on the application roller and a middle portion between the supporting edges serving to entrain and apply the coating material, the middle portion extending from the centre of the roller towards opposite sides of the roller as far as the last salient point or point of inflection of a peripheral cross-section or generating line (Mantellinie) representing the transverse profile of the roller and extending from one side of the roller to the other before the points or edges of the regions on said profile where the can body comes to bear against the supporting edges of the roller, or, in the absence of such a salient point or point of inflection, the middle portion extending as far as the points or edges of the regions where the can body comes to bear against the supporting edges of the roller, within a middle region of the middle portion the application roller having at least one depression in said profile, said middle region having a width of less than 60% of the width of the middle portion, and said profile in the middle region having at least one salient point (Knickpunkt) and/or at least two points of inflection (Wendepunkte).

The main advantage of the present device is that, with it, optimum layer thicknesses of the coating over the weld or solder seam can be achieved without difficulty, which thicknesses are neither too small for the stresses occuring during the long-term storage of corrosive contents nor too big for the tearing strength stresses which occur during the flanging over of the edges of the can bodies and which are above the tearing strength of the lacquer with large layer thicknesses. A further important advantage of the present device lies in that because of the construction of the application roller it is possible to apply a layer of lacquer with a profile which, with the greatest layer thickness immediately above the weld or solder seam and a layer thickness steadily decreasing towards the edges of the coating, corresponds to the requirements imposed by the existing stresses on an optimum coating.

In the present device, the appliation roller may advantageously be so constructed that the middle region of the middle portion thereof has a width of at least 5%, preferably more than 15% and preferablY at most 50% of the width of the middle portion of the roller and that furthermore, the middle portion of the roller has a width of at least 72%, preferably more than 80%, of the roller width. The most favourable results with regard to the formation of the coating can be achieved within these dimensional limits.

With regard to the depression in the middle region of the middle portion of the application roller, in the present device, with reference to straight median line, which extends parallel to the roller axis between the highest and lowest point of the peripheral surface cross-section of profile and which divides that part of the profile in the middle portion of the roller into component portions situated above and below the median line in such a manner that the areas between the profile and median line are equal in size above and below the median line, the deepest point of the depression should preferably have a greater distance than 0.775 times, preferably 0.82 times the distance of the highest point of the profile from the median line. Apart from exceptional cases, this lowest depth of the depression is needed in order to be able to apply sufficient coating material to form a protective layer with an adequate layer thickness over the weld or solder seam region at the inside of the can body. The lowest point of the depression should therefore preferably have a distance from the median line which is at least twice as great, preferably more than four times as great, as the distance of the highest point of the profile.

It is further an important advantage for the desired formation of the protective layer with the greatest layer thickness over the weld or solder seam and a layer thickness decreasing steadily towards the edges of the protective layer, if the distance of the peripheral surface cross-section or profile from the inside of the can body resting on the supporting edges in the direction perpendicular to the roller axis increases continuously from the outer ends of the middle portion towards the middle region of the middle portion and preferably up to this.

In a preferred form of embodiment of the present device, the application roller comprises only one depression in the middle region of its middle portion. In this case, the roller may advantageously be so constructed that the peripheral surface cross-section or profile comprises, in the middle region of the middle portion of the roller, at least one salient point situated preferably in the middle of the middle region and representing an inner edge in the peripheral surface of the roller and/or two points of inflection preferably situated symmetrically to the middle of the middle region and/or two salient points situated at the outer ends of the middle region and preferably likewise symmetrical to the centre thereof and each representing an outer edge in the peripheral surface of the roller. In this case, the profile line may, to particular advantage, comprise at least one salient point representing an obtuse-angled inner edge in the middle region of the middle portion of the roller. This preferred configuration represents a basic form of the present invention which leads to the general advantages already mentioned above. Further special advantages can be achieved by the following modifications of this basic form.

In a first advantageous modification of the basic shape the depression lies between two raised portions which are situated inside the middle region of the middle portion of the roller and preferably reach at least almost as far as the can body. In this case, the roller may appropriately be so constructed that the peripheral surface cross-section of profile comprises, in the middle region of the middle portion of the roller, at least one salient point preferably situated in the middle of the middle region and representing an inner edge in the peripheral surface of the roller and/or two points of inflection situated in the region of the depression and preferably symmetrical to the centre of the middle region and/or at least two salient points situated in the top region of the raised portions and preferably likewise symmetrical to the centre of the middle region and each representing an outer edge in the peripheral surface of the roller and/or two points of inflection situated outside the region of the depression and likewise preferably symmetrical to the centre of the middle region of the depression and preferably at the outer ends of the middle region as well as preferably likewise symmetrical to the centre thereof and each representing an inner edge in the peripheral surface of the roller. In this case, the peripheral surface cross-section or profile may, to particular advantage, comprise a salient point representing an obtuse-angled inner edge in the periphral surface of the roller, at the lowest point of the depression. The special advantage of this first modification of the basic form is that it is possible to apply coating material to can bodies having different diameters with one and the same application roller, in that pressure rollers disposed at the outside of the can body press the can body not only against the supporting edges of the application roller but also against the two raised portions provided thereon and as a result the space between the peripheral surface in the middle portion of the roller and the inner wall of the can body remains substantially equal in size on a change in the diameter of the can bodies produced.

In a second advantageous modification of the basic shape of the present device, the application roller comprises two depressions in the middle region of its middle portion and a raised portion situated between these and preferably reaching at least substantially as far as the can body. In this case, the roller may appropriately be so constructed that the peripheral surface cross-section or profile comprises, in the middle region of the middle portion of the roller, at least one salient point preferably situated in the middle of the middle region and representing an outer edge on the peripheral surface of the roller and/or two points of inflection situated in the region of the raised portion and preferably symmetrical to the centre of the middle region and/or at least two salient points situated in the region of the bottom of the depressions and preferably likewise symmetrical to the centre of the middle region and/or two salient points situated outside the region of the raised portion and preferably at the outer ends of the middle region as well as preferably likewise symmetrical to the centre thereof and each representing an outer edge in the peripheral surface of the roller.

In this case, the peripheral surface cross-section may, to particular advantage, comprise a salient point representing an acute-angled inner edge in the peripheral surface of the roller at each of the iowest points of the depressions. The special advantages of this second modification of the basic form lie in that, firstly layer thicknesses of the protective coating above the weld or solder seam can be realized which lie within a range, the upper limit of which is distinctly above the corresponding upper limit of the basic form and the lower limit of which is still within the range of thicknesses which can be realized with the basic form and so distinctly lower than the lower limit of the range of layer thicknesses which can be realized with the known roller applying protective coatings with a thicknes of about 200 microns, and that furthermore, the same advantages already mentioned can also be achieved with this second modification as with the above-mentioned first modification of the basic shape.

Furthermore, the application roller may, to advantage, be so constructed that the peripheral surface cross-section has a convex course which is at least substantially in the form of a circular line preferably with a larger radius of curvature than half the internal diameter of the can body, at least in the major portion of its length situated between the middle region of the middle portion of the roller and the outer ends of the middle portion. The radius of curvature of the circular course should preferably be between 1.25 times and 5 times half the internal diameter of the cam body. With such a construction of the application roller the advantageous continuous increase in the distance of the peripheral surface cross-section or profile from the inside of the can body resting on the supporting edges, from the outer ends of the middle portion towards the middle region of the middle portion, already mentioned above, is realized in an optimum form for the application of the coating material.

The lateral supporting edges serving to support the can body on the roller may appropriately be raised in comparison with the outer ends of the middle portion of the roller and each adjoin, with an obtuse-angled outer edge, on the associated side of the roller and, via an acute-angled outer edge, on the middle portion of the roller. The raised supporting edges have the advantage that they lead to a relativley sharp definition of the outer edges of the protective coating and substantially exclude marginal smudging. They are mainly provided when the distance of the peripheral surface cross-section or profile from the inside of the can body resting on the supporting edges increases relatively slightly from the outer ends of the middle portion towards the middle region of the middle portion. With a relative great increase in this distance, on the other hand, it is frequently more advantageous, in order to achieve a steady drop in the thickness of the protective coating from the centre towards its edges, if the supporting edges are situated lower than the outer ends of the middle portion and preferably each adjoin, with an obtuse-angled outer edge, on the associated side of the roller and with an obtuse-angled outer edge on the middle portion.

In both cases it is an advantage, in order to achieve a satisfactory support of the can body as well as to avoid a rapid wear of the supporting edges, if the peripheral surface cross-section or profile comprises, in the regions serving to support the can body on the roller, a convex curvature with a radius of curvature preferably corresponding to at least substantially half the internal diameter of the can body.

Furthermore, the present device may be further developed, to particular advantage, in such a manner that, in order to influence the layer thickness of the protective coating forming under the influence of the surface tension of the material after its application, means are provided to cool the weld or solder seam region of the can bodies, preferably in the form of means for producing a stream of cooling air directed onto the weld or solder seam region of the can bodies from the outside, before the application of the coating material and so to influence the heating of the applied material by the heated weld or solder seam region of the can body and to influence the surface tension of the material. This has the advantage that the thickness of the protective coating can be adapted, within a range of layer thicknesses substantially predetermined by the construction of the peripheral surface of the roller, to the demands which are made on the protective coating, by varying the cooling.

The invention is explained in more detail below both with regard to its general method of working and in some examples of embodiments with reference to the accompanying drawings, in which:

FIG. 1 shows the peripheral surface cross-section or generating line representing the transverse profile of an application roller of the present device with raised supporting edges and a circular course in the middle portion of the roller and a depression, which is triangular in cross-section, in the middle region of the middle portion, FIG. 2 shows a similar profile of an application roller of the present device with raised supporting edges and a course in the middle portion of the roller with curvature increasing continuously towards the centre and a bending point, forming the lowest point of a depression, in the middle region of the middle portion, FIG. 3 shows a similar profile of an application roller of the present device with raised supporting edges and a circular course in the middle portion of the roller and a depression, which is trapezoidal in cross-section, in the middle region of the middle portion, FIG. 4 shows a similar profile of an application roller of the present device with raised supporting edges and a circular course in the middle portion of the roller and a depression, which is cup-shaped, in the middle region of the middle portion, FIG. 5 shows a similar profile of an application roller of the present device with raised supporting edges and a circular course in the middle portion of the roller and a depression, which is situated between two raised portions and is triangular in cross-section, in the middle region of the middle portion, FIG. 6 shows a similar profile of an application roller of the present device with flat supporting edges and a course in the middle portion of the roller with curvature increasing continuously towards the centre and a bending point, forming the lowest point of a depression, in the middle region of the middle portion, FIG. 7 shows a similar profile of an application roller of the present device with raised supporting edges and a circular course in the middle portion of the roller and two depressions which are triangular in cross-section as well as a raised portion, which is situated between these and is trapezoidal in cross-section, in the middle region of the middle portion, FIG. 8 shows a similar profile of an application roller of the present device with flat supporting edges and a course in the middle portion of the roller with curvature increasing continuously towards the middle region and two turning points bounding a cup-shaped depression at the outer ends of the middle region of the middle portion, FIG. 9 shows an example of a protective coating, e.g. a layer of lacquer applied to the weld seam of a can body with the present device, in cross-section, FIGS. 10 and 11 show diagrammatic illustrations of the process during the application of the protective coating from the roller to the inside of the can body and the so-called "lacquer trails" forming in the course of this, to explain the mode of operation of the invention.

In the course of the investigations which have led to the present invention, it was found that a so-called "lacquer trail" 3 or 4 formed between the region of the weld seam acted upon with coating at the inside of the can body 1 and the parts of the application roller 2 moving away from the can body, as illustrated diagrammatically in FIGS. 10 and 11, the shape, size and stability of which trail primarily determine the characteristics of the layer of lacquer forming, so to speak, the end of the trail ending at the inside of the can body and covering the weld seam region. It was further found that the actual application of lacquer was effected mainly via this trail or more precisely that the main part of the total amount of lacquer transferred from the roller 2 to the inside of the can body 1 is applied not so much at the moment of contact between roller and inside of the can, as previously assumed, but rather only afterwards via this trail to the inside of the can body. From the physical point of view, the application process takes place in such a manner that the inside of the can body is wetted with lacquer substantially at the moment of contact between roller and inside of the can body and this wetting layer, which is at first still thin and adheres firmly to the metal surface at the inside of the can body, then draws off lacquer entrained by the roller, via the lacquer trail, from the roller.

The front of the trail has—as indicated by examples of the trails 3 and 4 in FIGS. 10 and 11—substantially the shape of a hyperbola, the asymptotes of which coincide with a straight line parallel to the axis of the can body at the inside of the can body and a tangent to the roller at the end point of the middle of the trail on the roller and the eccentricity of which, forming a measure of the length of the lacquer trail, is determined, in the stable state of the trail, by the surface tension and the viscosity of the lacquer as well as by the surface curvatures of the trail, particular at the apex of the hyperbola. Some of the lacquer, which is inside the trail between the inside of the can body and the branch of the hyperbola adjacent thereto as well as a connecting surface between the apex of the hyperbola and a straight line connecting the points of contact between roller and inside of the can body, is now withdrawn by the said wetting layer adhering to the inside of the can body from the roller at the inside of the can body, while the rest of the lacquer, which is inside the trail between the roller and the branch of the hyperbola adjacent thereto as well as the connecting surface between the apex of the hyperbola and the straight line connecting the points of contact between roller and inside of the can body, is again entrained by the roller.

From this it follows that the amount of lacquer applied to the inside of the can body is substantially proportional to the volume of the trail and the geometrical position of the maximum lacquer application of the branch adjacent to the inside of the can body is substantially proportional to the volume of the trail and the geometrical position of the maximum lacquer application of the branch adjacent to the inside of the can body of the hyperbola forming the front of the trail or more precisely the end of this branch of the hyperbola at the inside of the can body. Thus, in order to achieve a specific profile of the coating over the weld seam region, it is necessary, firstly to keep the volume of the lacquer trail within a certain range and secondly to ensure that a plurality of parallel trails cannot form but only a single trail and that this trail, which is formed afresh for each can body, always forms at the same place, that is to say always in the middle of the roller if the weld seam is situated over the middle of the roller.

In the case of all three above-mentioned requirements, it is a question of solving stability problems, which have hitherto not even been formulated to say nothing of having been solved. In order to be able to keep the volume of a lacquer trail within a certain range the size of the trail must be kept substantially constant and that is only possible if the trail, during its formation, simultaneously with eaching this size, also reaches a shape with which a stable state results in the sense of a mutual cancellation of all the forces acting on the trail. Now the forces acting are essentially the forces caused by the movement of teh can body and the rotation of the roller and transmitted to the trail as a result of the viscosity of the lacquer and acting in the sense of lengthening the trail, and the forces caused by the surface tension of the lacquer and the curvature of the surface of the trail. The forces caused by the convex curvature of the hyperbola front of the lacquer trail act in the sense of lengthening the trail and the forces caused by the concave curvature of the cross-section of the trail act in the sense of shortening the trail.

Thus in order that a stable state may occur, with a certain volume or a certain size of the trail, the concave curvature of the cross-section of the trail at the apex of the said hyperbola must be sufficiently large that the forces caused thereby and acting to shorten the trail cancel out the forces acting to lengthen the trail, namely the forces caused by the movement of can body and application roller and transmitted to the trail by the viscosity of the lacquer and the forces caused by the convex curvature of the hyperbolic front of the trail. That is to say, the lacquer trail, during its formation, simultaneously with reaching the said specific size, must also reach a shape with the said magnitude of the concave curvature of the cross-section of the trail at the apex of the hyperbola forming the front of the trail necessary for the equilibrium of forces, in order that a stable state may become established. Since the shape of the trail and in particular the width of the front determining the magnitude of the concave curvature of the cross-section of the trail at the apex of the trail front depends essentially on the construction of the peripheral surface of the roller, the volume of a lacquer trail can only be kept within a certain range of volumes if a roller with a suitably constructed peripheral surface is used and accordingly a certain desired profile of the coating over the weld seam region can only be achieved with a suitable application roller.

Now with the application rollers hitherto known, it was impossible to keep the volume of a lacquer trail within a certain range of volumes corresponding to the desirable profile of the coating over the weld seam range, mainly because the trails formed with the known rollers were too wide and therefore also had too wide a trail front so that there was too little curvature of the cross-section of the trail at the apex of the hyperbola forming the trail front. As a result, in turn, the trail-shortening forces caused by this inadequate concave curvature were too small, given the volume of lacquer trail necessary for the desirable profile of the coating over the weld seam region, to cancel out the trail-lengthening forces.

Therefore, with the application rollers hitherto known, either of two states could arise: In one case, a growth of the lacquer trail resulted up to a length at which the tension, at the surface of the trail, which acts in the sense of pulling the trail apart and which is produced by the forces caused by the rotating roller and transmitted by the viscosity of the lacquer to the trail, increases with growing length of trail until it is greater than the surface tension holding the surface of the trail together and the lacquer trail is therefore torn to about as far as the contact point between roller and inside of the can body after which it again builds up an grows until it tears again and thus oscillates in size like a saw-tooth oscillation (as was the case, for example with the application rollers shown in FIGS. 5, 6, and 8 of CH-PS No. 624591 and the application rollers shown in FIGS. 2 and 3A to 3D of U.S. Pat. No. 4,361,113 when using viscous coatings). In the other case a growth of the lacquer trail resulted up to a length at which the aforesaid tension tending to pull the trail apart was still just a little below the surface tension of the lacquer holding the surface of the trail together, and therefore the working conditions had to be adhered to very precisely in order to avoid a further increase beyond the surface tension of the lacquer, leading to tearing off of the trail, and the great length of trail associated with this high tension or the correspondingly large volume of the trail led to a very large application of lacquer on the weld seam region (as was the case, for example, with the application roller shown in FIGS. 4A and 4B of U.S. Pat. No. 4,361,113 when using the viscous coating given in this specification and adhering to the other working conditions which can be seen from it).

In both cases, that is to say both the oscillating trail and the trail with a length only slightly below the stability limit, even within the scope of the investigations which were carried out for checking purposes in connection with the present invention, there resulted the defects in the coatings over the weld seam already explained at the beginning, that is to say with rollers as in FIGS. 5, 6 and 8 of CH-PS No. 624591 and in the FIGS. 2 and 3A to 3D of U.S. Pat. No. 4,361,113 when using viscous coatings; namely as a result of the oscillating trail, there was an incomplete wetting in the marginal regions of the coating layer which comes about as a result of the fact that at the moment of tearing of the trail, a relatively large amount of lacquer like a large drop is applied and then, during the formation of the new trail, because of the initially still small volume thereof, only a small amount of lacquer is applied while with a roller as in FIGS. 4A and 4B of U.S. Pat. No. 4,361,113, using the viscous coating given there, as a result of the great length of the trail and the correspondingly large volume of the trail, a very great thickness of layer of the coating and consequently an inadequate tearing strength thereof during the flanging over of the edges of the can body.

Even a control experiment carried out within the framework of these investigations to clarify the question as to whether the said disadvantages could be eliminated by using less viscous coatings and a corresponding reduction in the forces caused by the movement of the can body and the rotation of the application roller and transmitted to the lacquer trail by the viscosity of the lacquer, did not lead to the achievement of stable, instead of oscillating, trails or to more stable coniditions with lengths of trail substantially below the stability limit. Rather, there appeared a new stability problem in that now, with the majority of known rollers, not only one but a plurality of parallel lacquer trails formed which were connected to one another in the transverse direction up to a portion of their total length and the lengths of which trails were generally not stable and equal in size but varied depending on one another because of the cross connections of the trails and which therefore led to an extremely irregular application of lacquer to the inside of the can body. The new stability problem which arose in this case is unclear insofar as when a plurality of lacquer trails appear which are connected to one another, purely theoretically an infinite number of different stable states may result under the same working conditions, whereas in the case of only one trail, with preset working conditions theoretically a single stable state results. For this reason alone as well as because of the irregularity in the application of lacquer at the inside of the can body resulting in practice and observed in the control experiment on the appearance of a plurality of parallel trails, a further condition for achieving a specific profile of the coating over the welding seam region would be to prevent the appearance of a plurality of parallel trails.

In detail, during the control experiment, a strong tendency towards the development of a plurality of parallel varnish trails was observed, particularly when rollers were used having pronounced raised portions in their peripheral surface. Thus such a tendency was found, in particular, with the roller shown in FIG. 3D of U.S. Pat. No. 4,361,113 with a wavy peripheral surface, which produced up to four parallel trails; that is to say one lacquer trail for each of the four half-wave-shaped raised portions of its peripheral surface could be observed. In addition, the rollers shown in FIGS. 3A and 2 of this US specification and, in particular, also the roller illustrated in FIGS. 4A and 4B showed such a tendency. This tendency to form up to three parallel trails with the roller according to FIGS. 4A and 4B of the US specification when less viscous coatings were used must also have been the reason why uniform coatings could be achieved with this roller only with a viscous coating and the very great layer thicknesses of the coatings it produced, while small layer thicknesses coming within the optimum range for coatings over the weld seam could not be achieved because of the tendency to form a plurality of parallel trails and the resulting irregularity of application produced with this roller when using less viscous coatings. The pronounced tendency to form a plurality of trails observed with the roller according to Figuze 3D of U.S. Pat. No. 4,361,113, must likewise be the reason for the lack of suitability of this roller for achieving uniform coatings over the weld seam region.

From the results of the control experiment it had to be concluded that the causes of the formation of a plurality of parallel trails are the centrifugal forces which act on the lacquer entrained by the application roller and which, with lacquers which are not too viscous, cause a flow of lacquer in the direction of the parts of the peripheral surface furthest away from the roller axis, within the lacquer entrained by the roller, and which therefore lead to the fact that the lacquer entrained by the roller moves towards the raised portions or more precisely towards the higher parts of the peripheral profile of the roller as a result of the rotation of the roller, and then become detached from the highest points of the roller in the form of lacquer trails after the lacquer which has collected in a kind of hill over these at the highest points has come into contact with the inside of the can body and has thus started the separation of these trails.

This recognition of the causes of the formation of a plurality of parallel trails can now be used to fulfil the above-mentioned condition, which has to be observed in order to achieve desirable profiles and in particular suitable layer thicknesses of the coating over the weld seam region, of keeping the volume of the lacquer trail within a certain volume range and for this purpose keeping small the width of the trail and hence also the width of the front of the trail and the length of the trail resulting therefrom and hence keeping small similarly the concave curvature of the cross-section of the trail at the apex of the hyperbola forming the front of the trail, which curvature determines the volume of the trail. For if the peripheral surface of the application roller is so constructed that the peripheral surface cross-section or profile of the roller or more precisely the distance of this from the axis in the middle portion of the roller, increases towards a middle region of the middle portion and there are maxima or peaks of the profile in this middle region or at the boundaries thereof, then the lacquer entrained by the roller collects at these maxima of the profile as a result of the rotation of the roller and after the accumulated lacquer has come into contact with the inside of the can body, parallel trails are detached from these maxima but, if the maxima are a sufficiently short distance apart or if the said middle region is sufficiently narrow they amalgamate to form a single relatively narrow trail.

That is to say, it is possible, so to speak, by producing a plurality of parallel trails situated close beside one another and therefore amalgamating with one another, to come to the required single relatively narrow trail, the volume of which leads to the required profile and the required layer thickness of the coating over the weld seam region and which always forms at the same place as a result of the fixing of its position by the said maxima of the profile and therefore forms directly over the weld seam at the inside of each can body passing through the application device.

Thus the following are important for the construction of an application roller suitable for applying a protective coating to the weld or solder seam of can bodies and rendering possible optimum coatings within a region covering the seam at the inside of the can bodies:

The peripheral surface cross-section or profile of the roller or rather its distance from the roller axis should comprise at least two maxima situated relatively close to one another and preferably substantially equal in height in the middle portion of the roller. In a middle region of the middle portion of the roller, at the outer limits of which or within these, these maxima lie, there should therefore be at least one depression in the peripheral surface of the application roller or at least one minimum of the distance of the peripheral surface of the roller from the roller axis. In addition, parts of the peripheral surface of the roller with a distance from the roller axis decreasing towards the outer ends of the middle portion should follow on the two maxima situated closest to the outer limits of the middle region of the middle portion of the roller or coinciding with the same, in the direction of the outer ends of the middle portion of the roller.

Within the two regions of the middle portion of the roller which extend from the outer ends of the middle portion to the nearest maximum situated inside the middle region of the middle portion of the roller or at its outer limit, the distance of the peripheral surface from the roller axis should preferably be less than at the nearest maximum associated with this and greater than or at least equally great as at the associated outer end of the middle portion of the roller and should preferably increase continuously from each of the two outer ends of the middle portion towards the associated nearest maximum. The required movement of the lacquer towards the two maxima is encouraged by this configuration.

In the regions of the supporting edges following on outwardly from the middle portion of the roller, the peripheral cross-sectional profile should preferably have shorter distances from the roller axis than at the two maxima situated closest to the outer limits of the middl region of the middle portion of the roller or coinciding with these. In addition, the points in the supporting edge regions with the greatest distance from the roller axis should preferably have only a slightly greater and preferably at least almost equal distance from the roller axis as the outer ends of the middle portion. As a result of this construction, lacquer trails can also be prevented from forming at the supporting edges.

With regard to the depression in the middle region of the middle portion, it should be noted that the said maxima situated in the middle region or at the outer limits thereof should be sufficiently pronounced to render possible or to encourage the formation of the required lacquer trails at these points, which requires a certain minimum depth or a certain minimum volume of the depression, but that on the other hand the volume of lacquer inside the depression and hence also the volume or the depth of the depression must not be too great, in order that the trails forming may not be forced apart by the volume of lacquer flowing out of the depression from the inside, but instead are pressed together by the flow from the outside so that they amalgamate in the desired manner to form a single trail.

The application rollers illustrated in FIGS. 1 to 8 by their peripheral surface cross-sections or profiles as examples of the invention fulfil all the conditions given above for a construction of such rollers rendering possible an optimum coating over the weld seam region.

The peripheral surface cross-sections or profiles 5 of the rollers in FIGS. 1 to 8 comprise, in a middle portion 6 of each roller, two maxima or outer boundaries 7 and 8 of equal height which are situated close beside one another and which are situated at the outer limits of a middle region 9 of the middle portion 6 of the roller (FIGS. 1–4 and 6–8) or inside the middle region 9 (FIG. 5). Between the maxima there is one depression 10 (FIGS. 1–6 and 8) or two depressions 10' and 10" with a raised portion 11 situated between them (FIG. 7). In the two regions 12 and 13 of the middle portion 6 which extend from the outer ends of the middle portion 6 to the middle region 9 of the middle portion 6, the height of the profile 5 increases continuously towards the associated nearast maxima 7 and 8 respectively. In the regions of supporting edges 14 of the roller, the profile 5 is closer to the roller axis than at the two maxima 7 and 8. The inner wall 15 of the can body, indicated in broken lines in FIGS. 1 to 8 rests on the supporting edges 14.

The supporting edges 14 are curved convexly with a curvature adapted to inner wall 15 of the can body. In the rollers illustrated in FIGS. 1 to 5 and 7, the points of the supporting edges 14 with the greatest distance from the roller axis are further from the axis by about 0.1 mm than the outer ends of the middle portion 6 and in the rollers illustrated in FIGS. 6 and 8, they have the same distance from the axis as these outer ends of the middle portion 6.

The depth of the depressions 10 or 10' and 10" in comparison with the maxima 7 and 8 is about 0.2 mm in the rollers with relatively wide depressions in FIGS. 1, 3 and 4, about 0.4 mm in the rollers with somewhat narrower depressions in the FIGS. 2, 6 and 8 and about 0.6 mm in the rollers which are provided with raised portions reaching as far as the inside of the can body in the middle region 9 of the middle portion 6. In all the rollers illustrated in FIGS. 1 to 4 and 6 to 8, the distance of the maxima 7 and 8 from the inside of the can body is about 0.3 mm.

Lacquer coatings over the weld seam region having a layer thickness over the seam up to about 60 microns can be applied with the rollers having profiles illustrated in FIGS. 1 to 4 and 6 to 8. Even greater layer thicknesses up to 80 or 100 microns can be achieved with the rollers in FIGS. 5 and 7 but there is generally no great need for layer thicknesses of more than 60 microns. With all the rollers illustrated, lacquer coatings over the weld seam region result having a width corresponding substantially to the width of the rollers of about 10 mm with the greatest layer thickness in the middle of the coating and therefore directly over the weld seam and the thickness decreasing towards the edges of the coating. The distribution of the layer thickness in the transverse direction of the coating can be further influenced to a certain extent by greater or lesser cooling of the can bodies on their way from the welding station to the application device by means of a stream of cooling air directed onto the weld seams from the outside, because the lacquer applied is heated by a weld seam which has not yet cooled down and the surface tension of the lacquer decreases with increased heating. A high surface tension can thus be achieved by powerful cooling of the can bodies and as a result it tends to pull the surface of the coating smooth and ensures an equalization of the layer thicknesses in the immediate vicinity of the weld seam to a certain extent.

On example of a lacquer coating which was applied with the application roller illustrated in FIG. 1 is shown in cross-section in FIG. 9. The coating was applied to the weld seam at the inside of a can body produced from sheet metal 0.2 mm thick. The roller used had a width of 10 mm and a peripheral profile as in FIG. 1 with supporting edges 14 0.5 mm wide, an elevation of the supporting edges 14 above the outer ends of the middle portion 6 of 0.1 mm, a circular course of the profile 5 in the regions 12 and 13 with convex form and a radius of curvature of 120 mm, a depth of the depression 10 in comparison with the maxima 7 and 8 of 0.2 mm, a distance of the lowest point of the depression 10 from the inside of the can body of about 0.5 mm and an angle between the two surfaces bounding the depression 10 of 160°.

A white-coloured lacquer known in the trade under the name "Grace Pillnay A 4699-S-77" was used for the coating. The following distribution of layer thicknesses in the transverse direction of the coating, which can be seen from FIG. 9, resulted (from left to right in FIG. 9): At a distance of 2 mm from the centre of the weld seam, a thickness of 14 microns, at a distance of 1 mm from the centre of the weld seam a thickness of 20 microns, at a distance of 0.5 mm from the centre of the weld seam a thickness of 50 microns, over the centre of the weld seam, a thickness of 40 microns, at a distance of 0.5 mm from the centre of the weld seam a thickness of 20 microns and at a distance of 1.5 mm from the centre of the weld seam a thickness of 10 microns.

Finally, it may also be pointed out that the present device for applying a protective coating to the weld or solder seam of a can body can be constructed, apart from the application roller, in the same manner as described, for example, in the CH-PS No. 624591 or the U.S. Pat. No. 4,361,1113, that is to say an application roller according to the present invention can easily be inserted in such a known device and, in conjunction with such a known device, can lead to the result achieved with the present invention. Further and more detailed explanation of the construction and mode of operation of these known devices is therefore superfluous in connection with the present invention. It may merely be mentioned that it is an advantage to drive the application rollers according to the present invention by a motor, preferably an electric motor, disposed beside the roller, in accordance with the recommendation already given in the CH-PS No. 624591 (page 3, right-hand column, lines 49–51). Furthermore the stripping device for the lacquer should preferably be so constructed that, when using application rollers according to the present invention, the lacquer is completely stripped off the supporting edges 14 (which can be achieved by a stripper almost bearing against the supporting edges 14), in order to exclude any possibility of the formation of lacquer trails at the supporting edges 14.

I claim:

1. A device for applying a protective coating to the weld or solder seams of can bodies, said device comprising an application roller which serves to apply a coating material over the region covering the seam at the inside surface of the can body, said roller having a profile defining laterally opposed convex shaped supporting edges which serve to support the can body on the roller and a generally convex shaped middle portion lying between said supporting edges which serves to entrain and apply said coating material, the profile of said middle portion having at least two maxima substantially equal in height and which are situated relatively close to one another and project a greater distance from the axis of rotation of said roller than the laterally opposed supporting edges, said maxima further defining the outer limits of a middle region of said middle portion, said middle region having at least one depression lying between said maxima and defining within said region a minimum distance between the axis of rotation of said roller and the surface of said roller, the distance from the surface of said roller to the axis of rotation of said roller at the laterally opposed outer ends of said middle portion being less than the distance from the surface of said roller at the nearest maxima associated with each of said ends to the axis of rotation of said roller, the distance from the surface of said roller to the axis of rotation of said roller increasing continuously from the end points of said middle portion to the nearest maxima, respectively, and the distance from the surface of each of said laterally opposed supporting edges to the axis of rotation of said roller being less than the distance from the surface of the nearest maxima associated with each of said supporting edges to the axis of rotation of said roller.

2. A device as claimed in claim 1, wherein the middle region of the middle portion of the application roller has a width of at least 5%, preferably more than 15% and appropriately at most 50% of the width of the middle portion.

3. A device as claimed in claim 1, wherein the middle portion of the application roller has a width of at least 72%, preferably of more than 80%, of the width of the roller.

4. A device as claimed in claim 1, wherein, with reference to a median straight line extending intermediate the highest and lowest points of the peripheral cross-section or profile parallel to the roller axis and dividing the profile of the middle portion of the roller into component sections above and below the line such that the areas situated between the profile and the line above and below the line are equal in size, the lowest point of the depression has a distance from said line greater than 0.775 times, preferably than 0.82 times, the distance of the highest point of the peripheral profile from said line.

5. A device as claimed in claim 4, wherein the lowest point of the depression has a distance from the median straight line which is at least twice as great, preferably more than four times as great, as that of the highest point of the peripheral profile.

6. A device as claimed in claim 1, wherein the application roller has only one depression in the middle region of its middle portion.

7. A device as claimed in claim 6, wherein the profile in the middle region of the middle portion of the application roller comprises at least one salient point preferably situated in the centre of the middle region and representing an inner edge in the peripheral surface of the roller and/or two points of inflection preferably situated symmetrically with respect to the centre of the middle region and/or two salient points situated at the outer ends of the middle region and preferably likewise symmetrical with respect to the centre thereof and each representing an outer edge in the peripheral surface of the roller.

8. A device as claimed in claim 6, wherein the peripheral profile line in the middle region of the middle portion of the roller comprises at least one salient point representing an obtuse-angled inner edge in the peripheral surface of the roller.

9. A device as claimed in claim 1, wherein the depression lies between the two maxima situated inside the middle region of the middle portion of the roller and the maxima preferably reaching at least substantially as far as the can body.

10. A device as claimed in claim 9, wherein the peripheral profile at the lowest point of the depression comprises a salient point representing an obtuse-angled inner edge in the peripheral surface of the roller.

11. A device as claimed in claim 1, wherein the roller comprises, in the middle region of its middle portion, two depressions and a raised portion situated between the same and preferably reaching at least substantially as far as the can body.

12. A device as claimed in claim 11, wherein the peripheral surface line comprises, at each of the lowest points of the depressions, a salient point representing an acute-angled inner edge in the peripheral surface of the application roller.

13. A device as claimed in claim 1, wherein the peripheral profile has, at least in the major part of its length situated between the middle region of the middle portion of the roller and the outer ends of the middle portion, a convex course which is at least substantially circular with a radius of curvature which is preferably greater than half the internal diameter of the can body.

14. A device as claimed in claim 13, wherein the radius of curvature of the circular course is between 1.25 times and 5 times half the internal diameter of the can body.

15. A device as claimed in claim 1, wherein the supporting edges are raised in comparison with the outer ends of the middle portion of the application roller and preferably each adjoin, with an obtuse-angled outer edge, on the associated side of the roller and, via an acute-angled outer edge, on the middle portion of the roller.

16. A device as claimed in claim 15, wherein the peripheral profile in the regions of the supporting edges serving to support the can body on the roller comprises a convex curvature with a radius of curvature preferably at least substantially corresponding to half the internal diameter of the can body.

17. A device as claimed in claim 1, wherein the supporting edges are situated lower than the outer ends of the middle portion of the roller and preferably each adjoin, with an obtuse-angled outer edge, on the associated side of the roller and with an obtuse-angled outer edge, on the middle portion of the roller.

18. A device as claimed in claim 1, wherein, in order to influence the layer thickness of the protective coating forming under the influence of the surface tension of the coating material after the application of the coating material, means are provided to cool the weld or solder seam region of the can body before the application of the material and so to influence the heating of the applied material by said heated seam region and to influence the surface tension of the material applied, the cooling means preferably being in the form of means for producing a stream of cooling air directed onto the weld or solder seam region from the outside.

19. A device as claimed in claim 1, wherein the distance of the peripheral profile of the roller from the axis of rotation, in the regions which extend from the outer ends of the middle portion of the roller as far as the middle region of the middle portion, is less than at the associated limit of the middle region and greater than or at least equally great as at the associated outer end of the middle portion and preferably increases continuously from each of these two outer ends towards the associated limit of the middle region.

20. A device as claimed in claim 1, wherein the peripheral profile of the roller has shorter distances from the roller axis in the regions of the supporting edges than at the two limits of the middle region of the middle portion of the roller.

21. A device as claimed in claim 1 wherein the point on the surface of each of said supporting edges having the greatest distance from the axis of rotation of said roller also having a slightly greater distance from the axis of rotation than the distance from the axis of rotation to the surface of said roller at said outer ends of said middle portion.

* * * * *